US009265985B2

(12) United States Patent
Uygan

(10) Patent No.: US 9,265,985 B2
(45) Date of Patent: Feb. 23, 2016

(54) CONVERTIBLE ARM CORD LOOP HANDLE

(71) Applicant: BALANCED BODY, INC., Sacramento, CA (US)

(72) Inventor: Viktor Uygan, Mission Viejo, CA (US)

(73) Assignee: BALANCED BODY, INC., Sacramento, CA (US)

( * ) Notice: Subject to any disclaimer, the term of this patent is extended or adjusted under 35 U.S.C. 154(b) by 0 days.

(21) Appl. No.: 14/528,414

(22) Filed: Oct. 30, 2014

(65) Prior Publication Data

US 2015/0157893 A1 Jun. 11, 2015

Related U.S. Application Data

(60) Provisional application No. 61/913,721, filed on Dec. 9, 2013.

(51) Int. Cl.
*A63B 21/04* (2006.01)
*A63B 23/08* (2006.01)
(Continued)

(52) U.S. Cl.
CPC ..... *A63B 21/4013* (2015.10); *A63B 21/4015* (2015.10); *A63B 21/4034* (2015.10); *A63B 21/0557* (2013.01); *A63B 21/08* (2013.01); *A63B 21/4011* (2015.10); *A63B 21/4017* (2015.10);
(Continued)

(58) Field of Classification Search
CPC ..... A63B 21/04; A63B 21/0442; A63B 21/0557; A63B 21/065; A63B 21/08; A63B 21/4011; A63B 21/4013; A63B 21/4015; A63B 21/4017; A63B 21/4019; A63B 21/4021; A63B 21/4034; A63B 21/4035; A63B 21/4033; A63B 2210/00; A63B 2023/006; A63B 23/08; A63B 23/085; A63B 23/10; A43B 11/00
USPC ..... 482/69, 79, 91, 121–126, 145
See application file for complete search history.

(56) References Cited

U.S. PATENT DOCUMENTS 735,065 A * 8/1903 Chellis et al. ..... A63B 21/0552 482/129
1,950,174 A * 3/1934 Harrison ..... A61H 1/0218 482/130

(Continued)

FOREIGN PATENT DOCUMENTS

CN 201119935 Y * 9/2008
EP 2799119 A1 * 11/2014 ..... A63B 21/0552
KR 2013-0032040 4/2013

OTHER PUBLICATIONS

International Search Report and Written Opinion, dated Mar. 10, 2015, from corresponding International Patent Application No. PCT/US2014/069362.

*Primary Examiner* — Oren Ginsberg
*Assistant Examiner* — Joshua Lee
(74) *Attorney, Agent, or Firm* — Greenberg Traurig, LLP

(57) ABSTRACT

An arm cord handle is disclosed that includes a flexible loop handle having a U shaped distal end and having proximal ends joined together at a common base portion. An external strap lies around and against the U shaped distal end in a storage position. The external strap has its ends fastened to the loop handle at a location spaced from the common base portion. The external strap can be deployed to an operational position away from the U shaped distal end of the flexible loop handle so that the arm cord handle is converted into a foot loop handle with the external strap positioned around a user's ankle while the U shaped distal end is positioned around the user's forefoot during exercise.

10 Claims, 5 Drawing Sheets

(51) Int. Cl.

| | |
|---|---|
| ***A63B 23/10*** | (2006.01) |
| ***A63B 21/002*** | (2006.01) |
| ***A63B 21/02*** | (2006.01) |
| ***A63B 26/00*** | (2006.01) |
| *A63B 21/055* | (2006.01) |
| *A63B 23/00* | (2006.01) |
| *A63B 21/08* | (2006.01) |

(52) U.S. Cl.

CPC ..... *A63B 21/4019* (2015.10); *A63B 21/4021* (2015.10); *A63B 21/4035* (2015.10); *A63B 23/08* (2013.01); *A63B 23/085* (2013.01); *A63B 23/10* (2013.01); *A63B 2023/006* (2013.01); *A63B 2210/00* (2013.01); *A63B 2210/50* (2013.01)

(56) References Cited

U.S. PATENT DOCUMENTS 2,594,097 A * 4/1952 Twyman ..... A61H 19/50 128/838
4,010,744 A * 3/1977 Boyen ..... A61H 1/0218 602/32
4,685,671 A * 8/1987 Hagerman ..... A63B 21/04 482/124
5,025,802 A * 6/1991 Laico ..... A61G 13/12 128/875
5,261,865 A * 11/1993 Trainor ..... A63B 21/154 482/124
D373,803 S * 9/1996 Winans ..... D21/684
5,558,609 A * 9/1996 Olschansky ..... A63B 21/0552 482/122
5,676,642 A * 10/1997 Peters ..... A61F 5/34 602/23
5,885,190 A * 3/1999 Reiter ..... A63B 7/00 482/129
6,168,556 B1 1/2001 Saavedra
6,390,957 B1 * 5/2002 Knight ..... A63B 23/08 482/121
6,450,930 B1 * 9/2002 Kroke ..... A61H 1/0255 482/121
7,452,340 B2 * 11/2008 Cook ..... A61H 23/04 601/151
7,699,761 B1 * 4/2010 Dieter ..... A63B 23/04 482/124
D674,448 S * 1/2013 Puig ..... D21/662
8,696,527 B2 * 4/2014 Wu ..... A63B 21/068 482/131
2002/0137608 A1 * 9/2002 Knight ..... A63B 21/143 482/124
2005/0043121 A1 * 2/2005 Tracy, Sr. ..... A63B 69/0057 473/438
2005/0085350 A1 4/2005 Shen
2005/0204455 A1 * 9/2005 Pelligra ..... A61B 17/42 2/310
2005/0282689 A1 * 12/2005 Weinstein ..... A63B 21/0552 482/124
2008/0039303 A1 * 2/2008 Wilcocks ..... A63B 21/0552 482/124
2011/0275493 A1 11/2011 Perez
2011/0306477 A1 * 12/2011 Keen ..... A63B 21/02 482/122
2012/0040808 A1 * 2/2012 Khademi ..... A63B 21/00043 482/124
2012/0100968 A1 * 4/2012 Tilton ..... A63B 21/0442 482/131
2012/0277074 A1 * 11/2012 Zeldakov ..... A63B 7/02 482/126
2013/0143724 A1 6/2013 Demeo
2013/0165301 A1 * 6/2013 Thrasher-Rudd ..... A63B 21/04 482/129
2013/0217547 A1 * 8/2013 Hinds ..... A63B 7/00 482/96

* cited by examiner

CONVERTIBLE ARM CORD LOOP HANDLE

CROSS REFERENCE TO RELATED APPLICATIONS

This application claims the benefit of priority of U.S. Provisional Patent Application Ser. No. 61/913,721 filed on Dec. 9, 2013 titled Convertible Arm Cord Loop Handle, the content of which is incorporated by reference in its entirety.

BACKGROUND OF THE DISCLOSURE

1. Field of the Disclosure

This disclosure generally relates to resistance based exercise equipment and more particularly to an arm cord handle for attaching a user's foot to an arm cord connected to a spring biased resistance exercise apparatus such as a reformer exercise apparatus utilized to perform various Pilates exercises.

2. Description of Related Art

Today, many types of exercise devices are available and used for fitness and/or medical reasons to burn off undesired calories, to improve cardiovascular ability, to tone or strengthen muscles, or to improve flexibility, balance, posture, etc. No matter what the desired end goal of a user of exercise equipment may be, almost all types of exercise equipment aid the user to achieve his or her desired goal by exerting some form of adequate and effective resistance against repeated bodily movements of the user.

A reformer is one such exercise device originally developed by Joseph Pilates. A reformer is basically a rectangular frame that sits on a floor and constitutes or carries a pair of stationary parallel rails or tracks. A movable carriage for supporting a user's body is mounted on the rails for movement toward and away from one end, the foot end, of the frame. The carriage is typically elastically biased toward the foot end of the frame by one or more coil springs having one end attached to the carriage and the other to a hook or post on an anchor bar near the foot end of the frame.

A pair of arm cords or ropes 8 that can be grasped by a user are attached at one end to the carriage. Each cord runs through a pulley generally located at the head end of the reformer. The free end of each arm cord typically has a handle or loop removably fastened thereto for the user to grasp with his or her hand. This handle is typically a single closed loop of fabric or leather, or alternatively may be a nested set of two loops, one larger one for large hands and an inner loop for those users with small hands.

Such loops are easily grasped in a user's hand. A user may also perform exercises wherein the user's foot engages the loop. However, during such use a user's foot can slip out of the loop because the user cannot easily grasp the loop itself.

To address this issue, Y-loop handles were developed that can be swapped for the regular hand loops or hard handles. These Y-loop handles are designed to fit a user's foot with one leg of the Y-loop around the user's instep or forefoot and the other leg of the Y-loop behind the user's heel, i.e., around the user's ankle, so as to maintain a more secure connection between the arm cord and the user's foot. A conventional Y-loop handle 10 is shown positioned properly on a user's leg 12 in FIG. 1 and a pair of Y-loop handles 10 is shown separately in FIG. 2.

A disadvantage with the Y-loop handles 10 is that they are separate handles and must be swapped out for the normally used single or double hand loops in order to be used. Furthermore, when the Y-loop handles 10 grasped by a user's hand, the extra loop is jutting out to the side and presents at least a distraction to the user. What is needed is a loop handle design that can also be used as a Y-loop for the user's foot when needed but remains out of the way when used as a regular loop handle. The present disclosure addresses this need.

SUMMARY OF THE DISCLOSURE

An arm cord handle in accordance with the present disclosure includes a flexible single or double loop handle having a U shaped distal end and has proximal ends joined together at a common base portion. An external strap is sewn around and lies against the U shaped distal end in a storage position. This external strap has its ends fastened to the loop handle at a location spaced from the common base portion. The external strap can be folded out and deployed to an operational position away from the U shaped distal end of the flexible loop handle. The user simply places the strap around his or her ankle while the U shaped distal end is positioned around the user's forefoot.

The common base portion is preferably configured to be fastened to one end of an arm cord that is removably and adjustably attached to one corner of a carriage of a reformer exercise apparatus. This flexible loop handle and the external strap are made preferably of a cotton webbing material. The arm cord handle preferably further has an inner loop handle nested within the flexible loop handle. The inner loop handle has proximal ends fastened to the common base portion. The external strap is fastened to the flexible loop handle at a location adjacent a distal end of the inner loop handle spaced from the common base portion.

These and other features and benefits of the arm cord handle in accordance with the present disclosure will become clearer from the following detailed description when taken in conjunction with the drawings described below.

DETAILED DESCRIPTION

Figure 1:
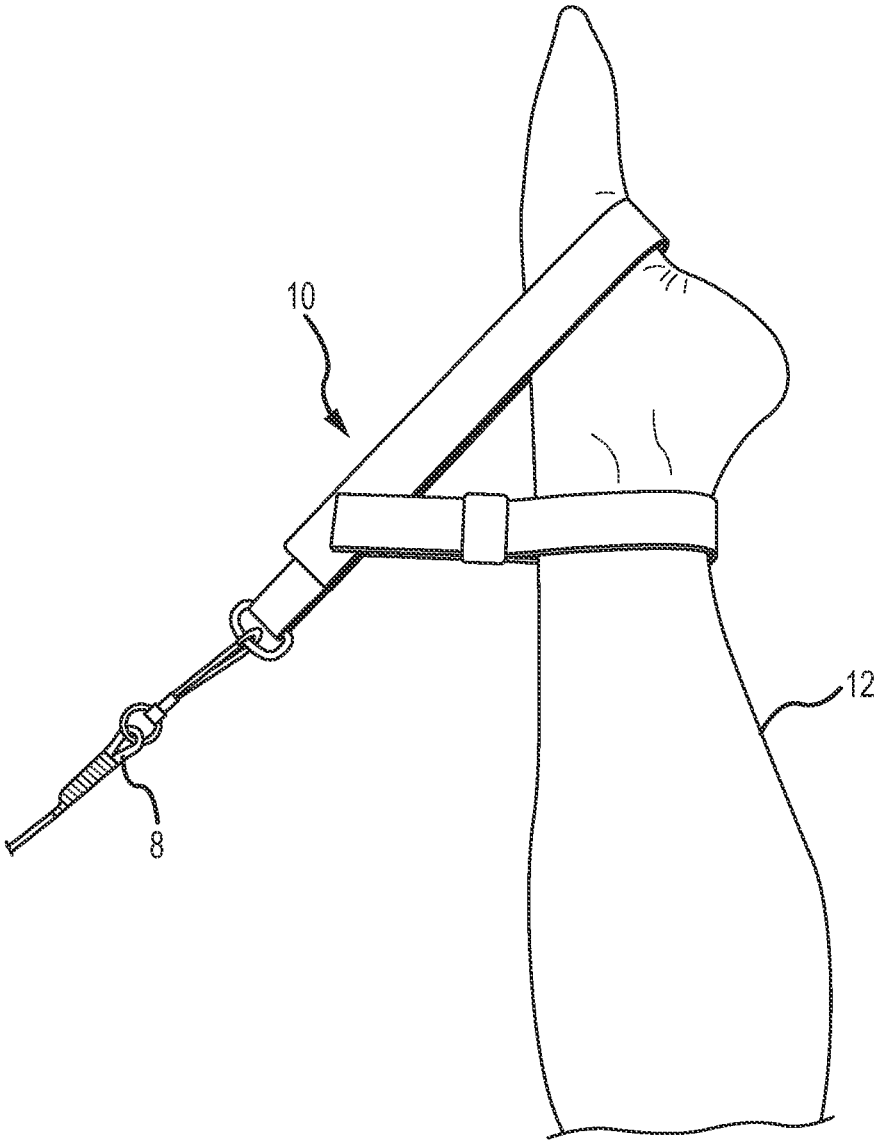
FIG.1 PRIOR ART
FIG. 1 is a view of a user's leg with a prior art arm cord Y loop handle attached to the user's foot.
Figure 2:
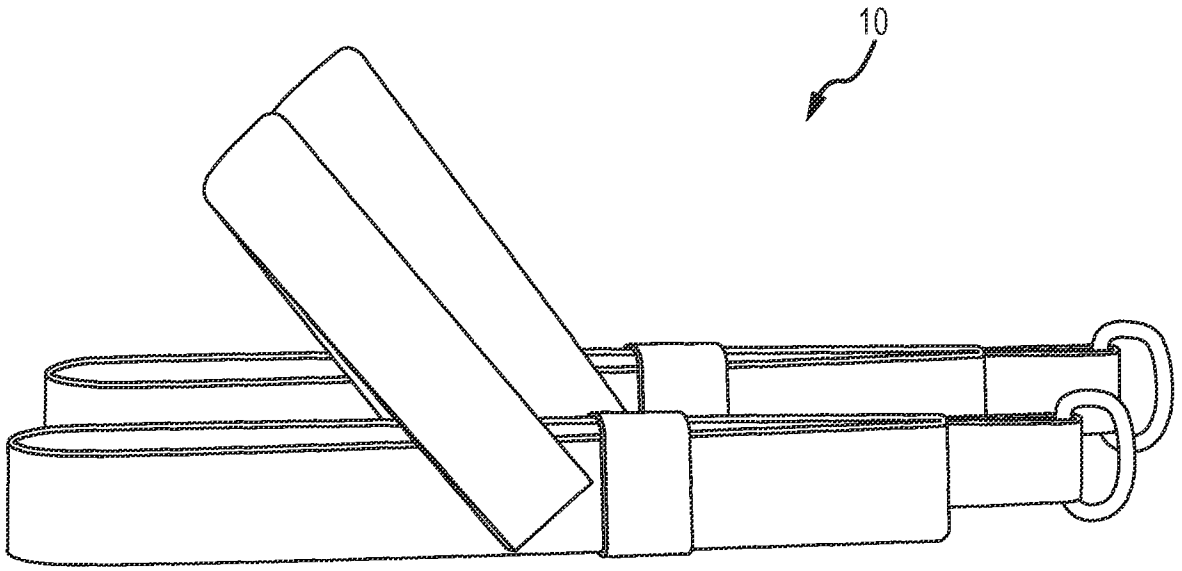
FIG.2 PRIOR ART
FIG. 2 is a separate side view of a pair of the prior art arm cord Y loop handles shown in FIG. 1.
Figure 3:
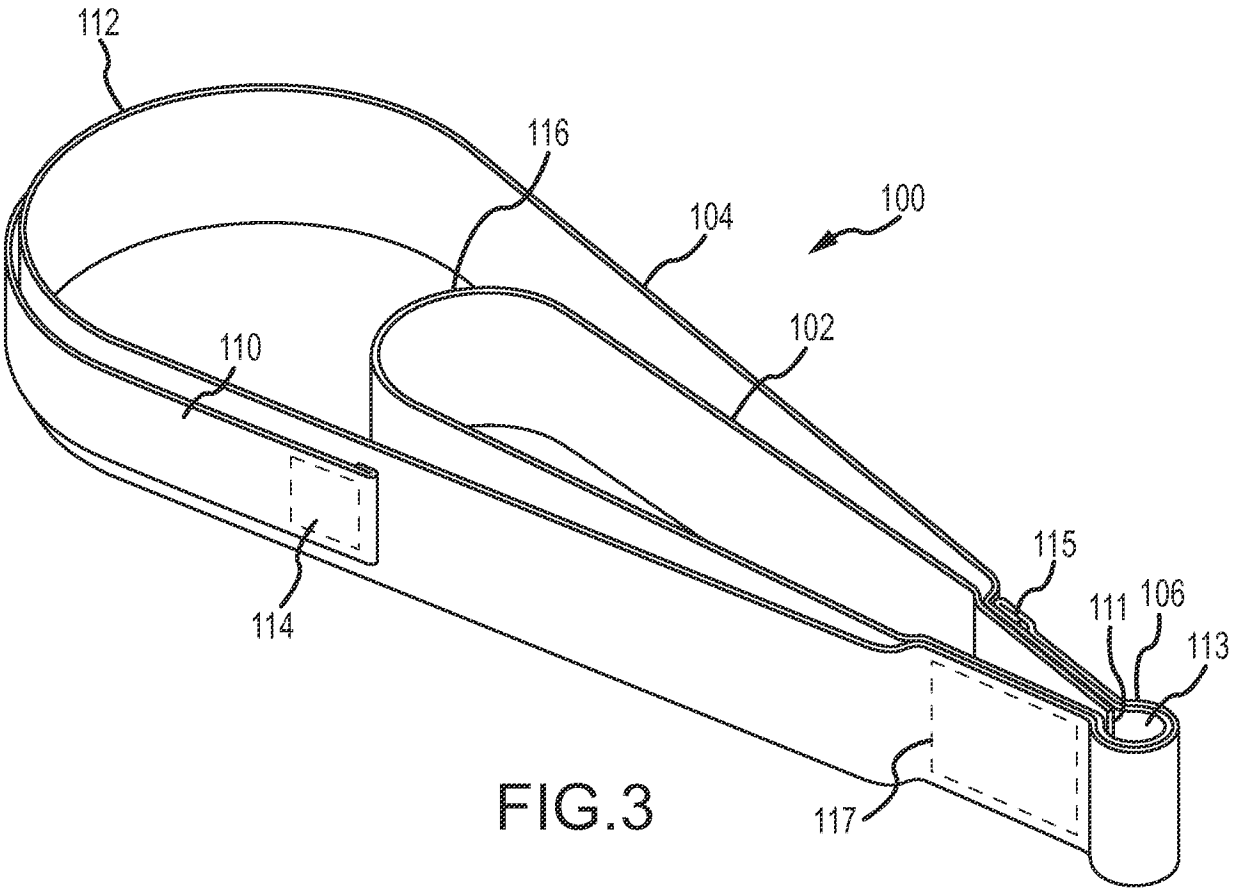
FIG. 3 is a perspective schematic view of a double loop arm cord handle according to an exemplary embodiment in accordance with the present disclosure.

The present disclosure addresses the need identified. An exemplary embodiment of an arm cord handle 100 in accordance with the present disclosure is shown in FIG. 3. This dual loop arm cord hand handle 100 has a nested inner loop 102 and an outer loop 104 each having U shaped distal ends 116 and 112. The proximal ends of the inner and outer loops 102 and 104 are joined together at a common base portion 106. The base portion 106 is in turn fastened to a link ring 108 (shown in FIGS. 4 and 5) for fastening the handle 100 to the free end of an arm cord 8 (FIG. 1).

This dual loop handle 100 has an external strap 110 that extends around the distal end 112 of the outer loop 104. Each end of the external strap 110 is fastened to the outer loop 104 at a location spaced from the base portion 106. This external strap 110, when in a storage position as shown in FIG. 3, is preferably snuggly abutted against the outside surface of the loop 104 such that it does not interfere with a user grasping the outer loop 104 with a hand in any way. Each end 114 of the external strap 110 may preferably be fastened to the outer loop 104 at a location adjacent to the distal end 116 of the inner loop 102.

This dual loop handle 100 is preferably made from a single piece of fabric or leather. One end 111 extends out from the base portion 106, forming an inner loop 102. This piece of fabric then wraps around the base portion 106 to form a sleeve 113 for receiving the ring 108, then back around and spaced from the inner loop 102 to form the outer loop 104. The piece of fabric is then wrapped around the sleeve 113 and its distal end 115 folded back on itself. The layers of fabric forming the base portion 106 adjacent the sleeve 113 are then sewn together at rectangular stitching 117.

Figure 5:
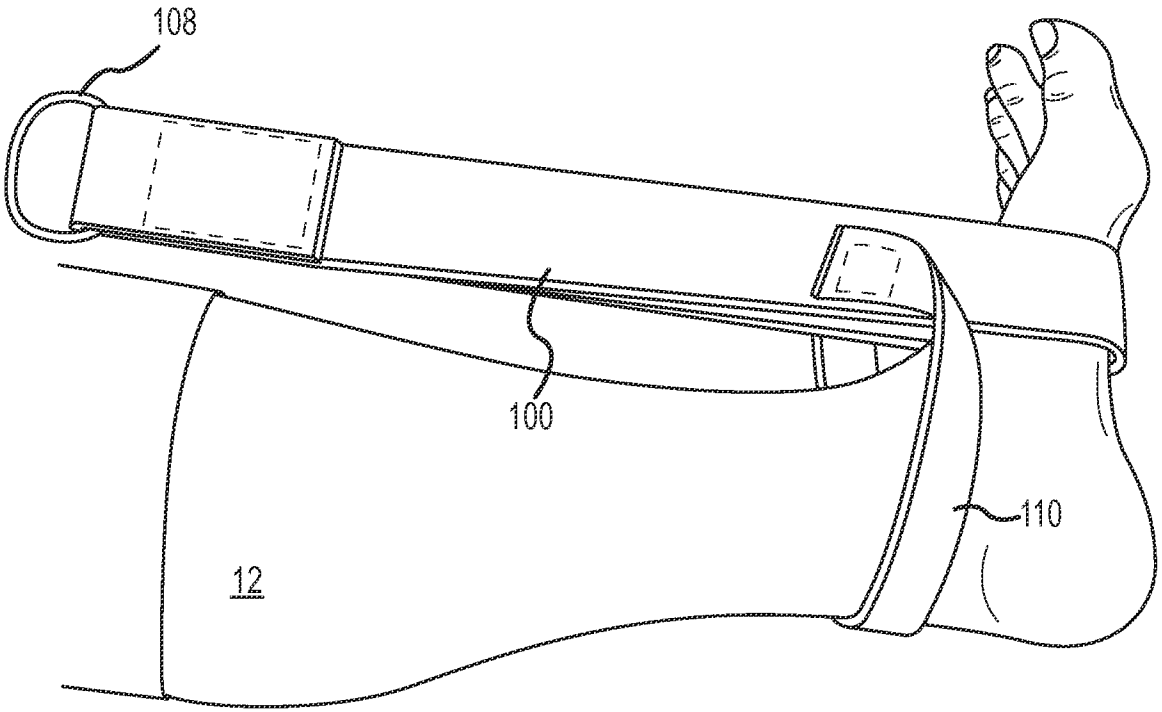
FIG. 5 is a side view of the double loop arm cord handle shown in FIG. 4 with the ankle strap deployed around the person's ankle.

In order to utilize the external strap 110, it is simply folded out from or lifted from against and around the distal end 112 of the loop 104, and positioned around the user's ankle as is shown in FIG. 5. The distal end 112 of the loop 104 is then positioned around the user's forefoot. A separate length of Velcro fastener fabric may be utilized to secure the external strap 110 in place around the user's ankle. The result is a configuration on the user's leg similar to that shown in FIG. 1.

Figure 4:
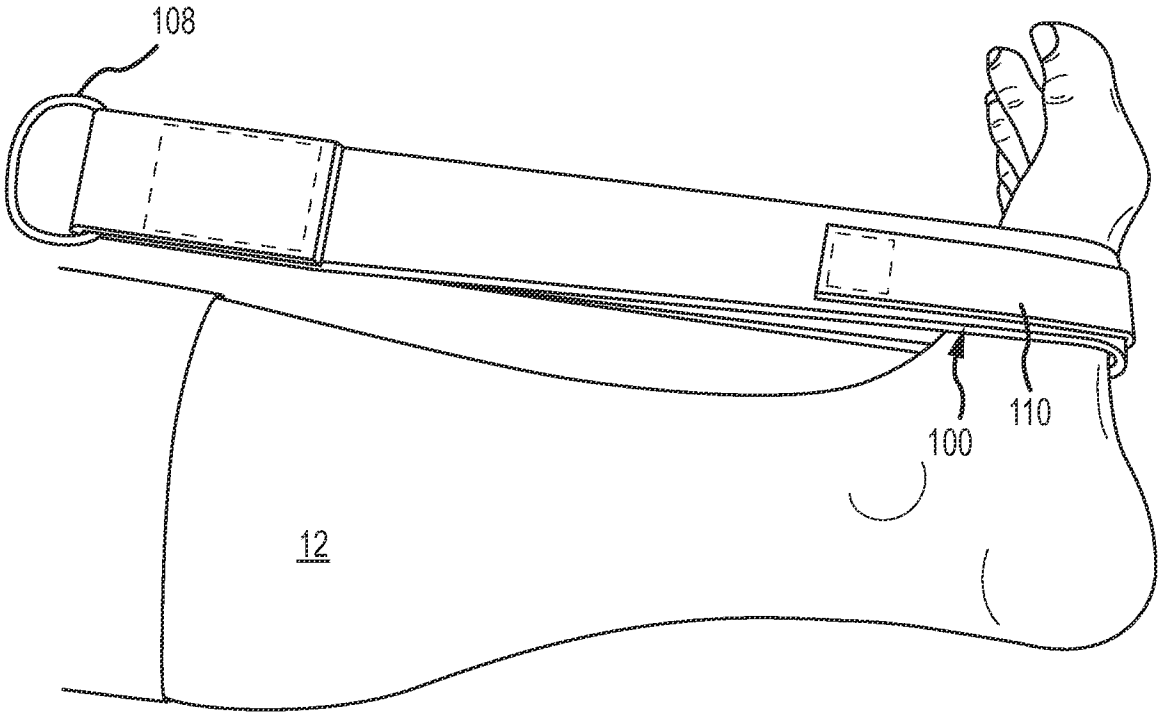
FIG. 4 is a side view of the double loop arm cord handle shown in FIG. 3 positioned for use around a person's foot with the ankle strap in a storage position.

This embodiment 100 differs substantially from conventional y loop handles. It adjusts to fit multiple size feet since the angle of the "Y" is not fixed. This feature alone enhances proprioceptive feedback. The strap 110 hides away when not in use, and becomes part of the regular outer loop 104, as is shown in FIG. 4, which enables the user to avoid having to change entire loop systems to get extra support during an exercise.

Preferably the external strap 110 can be made from a 1 inch wide cotton webbing sewn to the outside face of a 1.5 inch wide cotton webbing loop 104. In this case, the distance from the outer end 112 of the loop 104 to the distal stitch line, when folded flat, is preferably about 4½ inches. Thus the total length of the external strap 110 from stitch end to stitch end is preferably about 11 inches in this exemplary embodiment. Other dimensions may be chosen, of course, as the above are merely exemplary.

Various external strap materials may also be utilized such as polyester, polypropylene or nylon webbing, wool, leather, vinyl, elastic, felt or fleece materials. The ends of the external strap 110 may be secured to the loop 104 by sewn connection, Velcro, snap fasteners, rivets, grommets, or glue, although sewn stitching is currently preferred. Furthermore, the strap 110 could be configured to reside along the inside surface of the outer loop 104, in which case it would be an internal strap serving the same function.

Although the embodiment 100 shown is a double loop handle configuration the innovation here could alternatively be incorporated into a single loop handle, in which inner loop 102 is simply omitted. Furthermore, an additional external strap 110 may be provided in the double loop handle configuration on the exterior of the inner loop 102 for those situations where the handle 100 is to be utilized by users having smaller legs, such as for children or smaller adults.

It will be clear that embodiments of the present disclosure are well adapted to attain the ends and advantages mentioned as well as those inherent therein. While a presently preferred embodiment has been described for purposes of this disclosure, numerous changes may be made which will readily suggest themselves to those skilled in the art and which are encompassed in the spirit of the disclosure as set forth in the following claims. Accordingly, all such alternatives are encompassed within the spirit and scope of the appended claims.

What is claimed is:

1. An arm cord handle comprising:

a flexible loop handle having a U shaped distal end and having proximal ends joined together at a common base portion; and an external strap lying parallel to and lying against an outside surface of the U shaped distal end in a storage position, the external strap having its ends fastened to the loop handle at a location spaced from the common base portion, wherein the external strap can be deployed to an operational position away from the U shaped distal end of the flexible loop handle and positioned around a user's ankle while the U shaped distal end is positioned around the user's forefoot.

2. The arm cord handle according to claim 1 wherein the common base portion is configured to be fastened to an arm cord.

3. The arm cord handle according to claim 1 wherein the flexible loop handle and the external strap are made of a cotton webbing material.

4. The arm cord handle according to claim 1 further comprising an inner loop handle nested within the flexible loop handle, the inner loop handle having proximal ends fastened to the common base portion.

5. The arm cord handle according to claim 4 wherein the external strap is fastened to the flexible loop handle at a location adjacent a distal end of the inner loop handle spaced from the common base portion.

6. A convertible arm cord handle comprising:

a flexible loop handle having a U shaped distal end and having proximal ends joined together at a common base portion; and an external strap lying parallel to and lying against an outside surface of the U shaped distal end in a storage position, the external strap having each of its ends fastened to the loop handle at locations spaced from the common base portion, wherein the arm cord handle is converted into a foot handle by folding the external strap to a deployed operational position away from the U shaped distal end of the flexible loop handle wherein the external strap is positioned around a user's ankle while the U shaped distal end extends around the user's forefoot.

7. The arm cord handle according to claim 6 wherein the common base portion is configured to be fastened to an arm cord.

8. The arm cord handle according to claim 6 wherein the flexible loop handle and the external strap are made of a cotton webbing material.

9. The arm cord handle according to claim 6 further comprising an inner loop handle nested within the flexible loop handle, the inner loop handle having proximal ends fastened to the common base portion.

10. The arm cord handle according to claim 9 wherein the external strap is fastened to the flexible loop handle at a location adjacent a distal end of the inner loop handle spaced from the common base portion.

* * * * *